US010124994B2

(12) United States Patent
Torghele

(10) Patent No.: US 10,124,994 B2
(45) Date of Patent: Nov. 13, 2018

(54) BALLAST APPARATUS AND CRANE, IN PARTICULAR CRAWLER-MOUNTED CRANE

(71) Applicant: Liebherr-Werk Nenzing GmbH, Nenzing (AT)

(72) Inventor: Richard Torghele, Bartholomäberg (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 352 days.

(21) Appl. No.: 15/007,910

(22) Filed: Jan. 27, 2016

(65) Prior Publication Data

US 2016/0221804 A1 Aug. 4, 2016

(30) Foreign Application Priority Data

Jan. 28, 2015 (DE) ..... 10 2015 001 080

(51) Int. Cl.
*B66C 23/00* (2006.01)
*B66C 23/76* (2006.01)

(52) U.S. Cl.
CPC ..... *B66C 23/76* (2013.01)

(58) Field of Classification Search
CPC ..... B66C 13/46; B66C 23/53; B66C 23/72; B66C 23/76
See application file for complete search history.

(56) References Cited

U.S. PATENT DOCUMENTS

| | | | | |
|---|---|---|---|---|
| 2,693,250 A | 11/1954 | Barrett | | |
| 3,236,391 A | 2/1966 | Kennedy | | |
| 3,378,148 A | 4/1968 | Stanley | | |
| 4,358,021 A * | 11/1982 | Helm | B66C 23/36 | 212/195 |
| 4,601,402 A * | 7/1986 | Helm | B66C 23/36 | 212/178 |
| 2011/0031202 A1* | 2/2011 | Pech | B66C 23/76 | 212/178 |
| 2011/0031728 A1* | 2/2011 | Arzberger | B66C 23/74 | 280/755 |
| 2013/0270209 A1* | 10/2013 | Stuehrwoldt | B66C 23/76 | 212/196 |
| 2015/0210515 A1* | 7/2015 | Pech | B66C 23/76 | 212/197 |
| 2016/0280517 A1* | 9/2016 | Oelberger | B66C 23/36 | |
| 2016/0289047 A1* | 10/2016 | Albinger | B66C 13/16 | |

FOREIGN PATENT DOCUMENTS

| | | |
|---|---|---|
| DE | 39 15 771 A1 | 3/1990 |
| DE | 20 2010 003 190 U1 | 7/2010 |
| EP | 2 281 771 A1 | 2/2011 |
| EP | 2 657 176 A1 | 10/2013 |

* cited by examiner

*Primary Examiner* — Emmanuel M Marcelo
(74) *Attorney, Agent, or Firm* — Dilworth & Barrese, LLP

(57) ABSTRACT

The present invention relates to a ballast apparatus for attaching to the rear of a crane superstructure, in particular of a crawler-mounted crane, having a base plate and a plurality of stackable ballast plates, wherein at least two carrier plates for receiving stacked ballast plates are connected to the base plate in an articulated manner pivotable about vertical pivot axes.

17 Claims, 2 Drawing Sheets

DETAIL "II"
DETAIL "I"
10
A
A'
24
25
26

BALLAST APPARATUS AND CRANE, IN PARTICULAR CRAWLER-MOUNTED CRANE

BACKGROUND OF THE INVENTION

The invention relates to a ballast apparatus for attaching to the rear of a crane superstructure, in particular of a crawler-mounted crane, having a base plate and a plurality of stackable ballast plates.

There is generally a risk of tilting for a machine such as a crawler-mounted crane which stands freely on the ground when the tilting torque caused by the effect of the load and the inherent weight becomes larger than the standing torque of the machine. The function of the rear ballast or of the ballast in general is the reduction or the compensation of the active tilting torque. The rear ballast in the crane is typically arranged at the rotatable upper part and in the opposite direction to the payload. In a crawler-mounted crane, the rear ballast has previously been arranged in a fixed position at the rear of the superstructure.

During crane operation, the forces and torques acting on the machine can vary abruptly, for example by an increase or decrease of the radius of the load. Fixed-position rear ballasts do not allow any flexible adaptation to the changed operating conditions. If e.g. the active tilting torque is increased by an increase in the working radius, the stability of the machine decreases since the compensating rear ballast torque remains constant due to the fixed-position location of the ballast with respect to the superstructure. Only a complex and/or expensive increase of the ballast weight by taking up further ballast plates provides a remedy.

The use of movable ballast apparatus is already known from the prior art. A solution for setting the rear ballast during crane operation is disclosed in EP 2 281 771 A1. Here, the rear ballast is horizontally displaced via a complex rail mechanism or telescopic mechanism, i.e. the ballast can either be moved closer to the crane superstructure or can alternatively be moved further away from it.

A similar variant is known from EP 2 657 176 A1 in which the rear ballast is distanced from the superstructure by a horizontal displacement and is additionally raised upward.

However, both solutions require a comparatively complex ballast actuation design.

With machines of small dimensions, the total machine width is typically defined by the rear ballast. When passing through narrow points on the construction site, it can therefore be necessary to dismantle the rear ballast, which unnecessarily increases the resulting equipping time and thus reduces the operation readiness of the machine. A solution of this problem which makes the complex and/or expensive dismantling superfluous is not yet known from the prior art.

SUMMARY OF THE INVENTION

It is therefore the object of the present invention to provide an innovative design of a ballast apparatus for a rear ballast which allows the above-named problem to be overcome.

This object is achieved by a ballast apparatus for attaching to the rear of a crane superstructure in accordance with the features herein. Advantageous embodiments of the ballast apparatus are the subject of the features herein.

In accordance with the invention, a ballast apparatus is proposed for attaching to the rear of a crane superstructure, in particular of a crawler-mounted crane, which comprises a base plate at which one or more connection points, preferably bolting points, are provided for installation at the rear of a crane superstructure. In accordance with the invention, at least two carrier plates are connected to the base plate in an articulated manner pivotable about vertical axes. The carrier plates can be connected in an articulated manner pivotable about a common pivot axis; however, separate pivot axes of the carrier plates disposed offset from one another are preferred.

The carrier plates serve the reception and stacking of individual ballast plates. A particularly simple design of a movable rear ballast is disclosed whose production and installation is less complex and therefore less expensive with respect to the known solutions from the prior art. In addition, this apparatus allows a flexible adaptation of the total width of the ballast apparatus. It is preferred in this case that the carrier plates can be pivoted rearwardly, i.e. behind the crane rear or behind the base plate in the installation position.

Ideally, they can each be pivoted by approximately 90° behind the base plate viewed in the direction of travel. The width dimension of the ballast apparatus can thereby temporarily be considerably reduced and the track width can thus be reduced with specific crane models. Passing through narrow points on the construction site can be possible without dismantling the ballast apparatus. This saves equipping time and thus increases the operation readiness of the crane.

In a preferred embodiment of the invention, the carrier plates are each connected in an articulated manner to the base plate pivotable about a carrier arm. The articulated connection of the carrier arm preferably takes place via a finger-type fork connection with the base plate.

The drive of the carrier plates or of the carrier arms can take place via a common actuator, with in this case both carrier arms being actuated or pivotable synchronously with one another. Alternatively, separate actuators can be used to be able to provide a separate actuation of the carrier plates.

A rotary drive is used as the actuator and, for example, directly drives the pivot axis of the carrier arms. A linear drive can alternatively be used, preferably in the form of a lift cylinder. In this case, transmission means are necessary to convert the linear movement into the rotary movement or pivot movement. The actuator or the drive can be electric or hydraulic.

To hold the position of the carrier plates in a secure position, the lift cylinder used is preferably equipped with a lowering brake. The same naturally applies to the use of a rotary drive which can be equipped with adequate braking means or fixing means.

The actuator(s) and any mechanical coupling means are at least largely supported on the base plate. In addition, any connection points for the energy supply of the actuators can be arranged freely accessible at the base plate to ensure a simple installation of the ballast apparatus at the crane superstructure, including the connection of any necessary energy supply lines for the energy supply of the one or more actuators from the superstructure or from the undercarriage.

On a use of a single actuator for at least two carrier plates, it is necessary that mechanical coupling means are provided which mechanically couple the actuator to both carrier plates or carrier arms. In this respect, the use of a linkage and/or of a gear train is conceivable.

In a preferred embodiment, at least one pinion per carrier plate is provided, the pinion being drivable by the actuator(s) and directly or indirectly meshing with or driving an associated toothed arrangement of the carrier plate or of the carrier arm. The gear train can be of a single-step or multi-step design, in particular when an adaptation of the direction of rotation is necessary for the respective carrier arm.

It is conceivable that the at least two pinions are mechanically connected to one another via a coupling rod to transmit the rotary movement of one pinion to the coupled pinion. In this case, both pinions can be driven synchronously by a single actuator.

It is possible that at least one pinion comprises a fixedly connected actuation lever for coupling with the piston rod of an actuator in the form of a lift cylinder. The linear movement of the piston rod can thereby be particularly simply converted into a rotary movement of the pinion. For this purpose, it is sensible for the lift cylinder likewise to be movably connected to the base plate in an articulated manner.

It is expedient for a monitoring of the ballast position or of a corresponding control to provide a suitable sensor system for measuring the ballast position. It can be designed, for example, in the form of a sensor system for measuring the angle of rotation of a rotary drive or for measuring the pivot angle of the carrier plates. On a use of a sensor system for measuring the angle of rotation, it is sensible to design it with a redundant cam limit switch which serves the safeguarding of the angular measurement. Alternatively, the use of a sensor system for detecting the stroke of an actuator is possible in the form of a lift cylinder.

In addition to the ballast apparatus in accordance with the invention, the present invention also relates to a crane, in particular a crawler-mounted crane, having a superstructure and at least one ballast apparatus in accordance with the present invention arranged at the rear region. The crane is consequently characterized by the same advantages and properties as the ballast apparatus in accordance with the invention so that a repeating description at this point is dispensed with.

The crane furthermore comprises a crane control which calculates the influence of the position of the carrier plates and the displacement of the center of gravity associated therewith on the possible payload of the crane. The possibility thereby exists of likewise using this influence for the load torque limitation of the crane control so that it can always be ideally adapted to the current ballast situation.

BRIEF DESCRIPTION OF THE DRAWINGS

Further advantages and particulars of the invention will be explained in detail with reference to an embodiment shown in the drawing. There are shown.

DESCRIPTION OF THE PREFERRED EMBODIMENTS

Figure 1A:
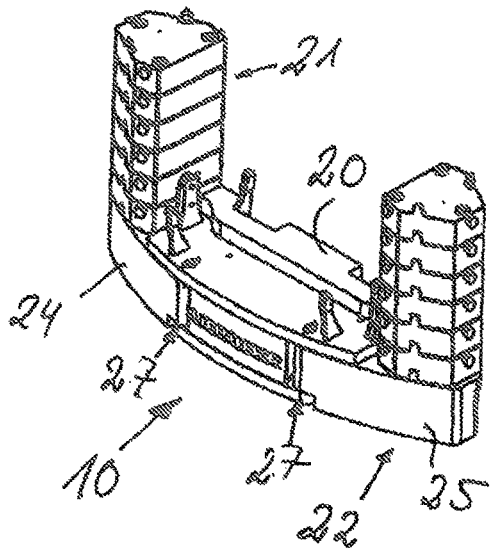
FIGS. 1A and 1B: perspective representations of the ballast apparatus in accordance with the invention with different pivot positions.
Figure 1B:
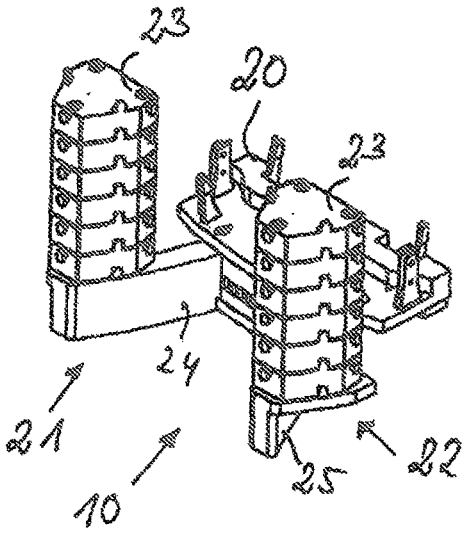

FIGS. 1*a*, 1*b* show a perspective representation of the ballast apparatus 10 in accordance with the invention. It is suitable for attachment to the rear of a crane superstructure so that the ballast apparatus 10 or the ballast 23 taken up is arranged at the crane in the opposite direction to the payload and counteracts the tilting torque active by the load. The ballast apparatus 10 is consequently a rear ballast.

The apparatus 10 comprises a base plate 20 at which two ballast towers 21, 22 are pivotably arranged. The ballast towers 21, 22 each comprise a plurality of ballast plates 23 stacked on one another. The ballast apparatus 10 can be installed at the crane superstructure in a conventional manner with the aid of the base plate 20 and can, for example be bolted to the superstructure frame via suitable bolting positions.

The representation of FIG. 1*a* shows the ballast apparatus 10 in the regular starting position in which the ballast towers 21, 22 are pivoted to the side. In this state, the ballast apparatus 10 corresponds with respect to the physical dimension to a conventional rear ballast in crawler-mounted cranes which is installed at the rear of the superstructure. FIG. 1*b* reflects the key idea of the present invention according to which both ballast towers 21, 22 can be pivoted to the rear. In this position, the spacing between the superstructure and the ballast plates 23 is at a maximum so that the total center of gravity of the ballast plates is changed with respect to the crane. It is thus possible to react flexibly to changed payload situations of the crane by pivoting the ballast towers 21, 22 and indeed all the more since the pivot mechanism of the ballast towers 21, 22 allows a continuous pivoting over a pivot radius of approximately 90°.

The possibility of a flexible displacement of the center of gravity increases the stability of the machine and as a further consequence reduces the ground pressure present or distributes it more evenly over the contact area. Conversely, larger tilting torques can be transmitted with an unchanged stability. A further substantial advantage can also be found in the fact that the base ballast can be reduced with the same stability. This reduces the machine's own weight and thus the ground pressure overall.

Figure 2A:
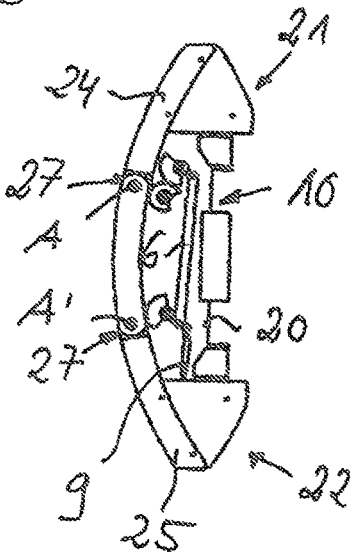
FIGS. 2A and 2B: two plan views of the ballast apparatus in accordance with FIGS. 1A and 1B.
Figure 2B:
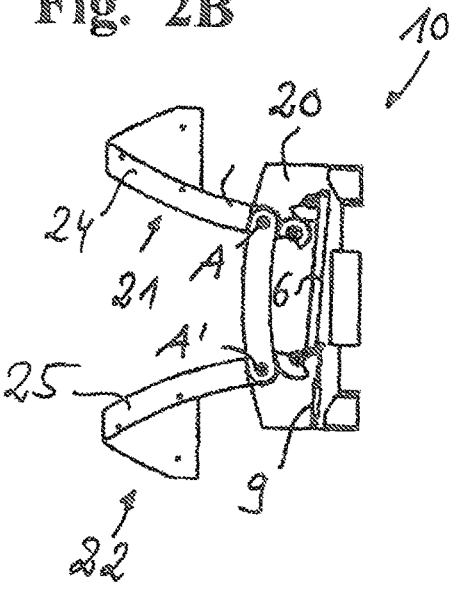

The significantly reduced machine width with outwardly pivoted ballast towers 21, 22 (FIGS. 1*b*, 2*b*), which allow a passing through of narrow points without a complex and/or expensive dismantling of the rear ballast, is to be listed as an important secondary function. This saves equipping time and thus increases the operation readiness of the machine.

Figures 3A, 3B, 3C:
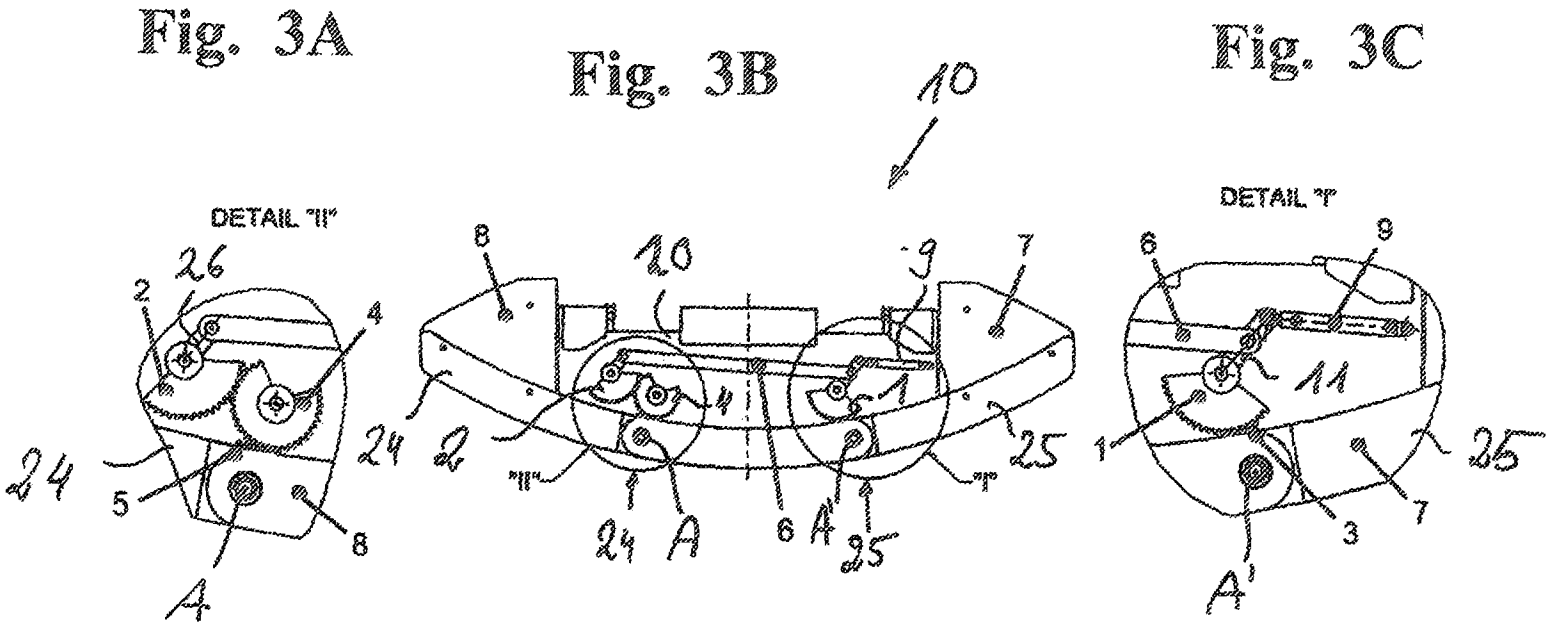
FIGS. 3A, 3B and 3C: plan views of the ballast apparatus in accordance with the invention, including two detailed representations of the mechanical coupling means between the carrier plates pivotably arranged in an articulated manner.

The specific design of the ballast apparatus 10 will now be explained further with reference to FIGS. 2 and 3. The pivotable rear ballast 10 is based on the base plate 20 to which carrier arms 24, 25 are connected in an articulated manner pivotable about the vertical axes A, A' via a finger-type fork connection 27. Carrier plates 7, 8, on whose surface ballast plates 23 can be stacked, are provided at the free end of the carrier arms 24, 25. The base surface of the carrier plates 7, 8 substantially corresponds to the base surface of the ballast plates 23.

Both carrier arms 24, 25 are thus connected in an articulated manner pivotable about vertical axes A, A' offset laterally from one another. A lift cylinder 9 serves the actuation of the ballast towers 21, 22 in the embodiment of FIGS. 2 and 3. The piston rod or the eye of the piston rod of the lift cylinder 9 is connected in an articulated manner pivotably at an actuation lever 11 of the first pinion 1 at the end side. The linear movement of the lift cylinder 9 is thereby converted into the required rotational work of the pinion 1.

A coupling rod 6, which serves the force transmission of the force applied via the lift cylinder 9 to a second pinion 2, is likewise rotatably supported at the actuation lever 11. This pinion 2 likewise comprises an actuation lever 26 which is pivotably connected at the end side to the coupling rod 6.

The toothed arrangement of the pinion 2 engages into a further gear 4 such that the toothed arrangement 5 of the left carrier arm 24 meshes. The pinion 1 accordingly meshes with a toothed arrangement 3 of the right carrier arm 25. The ballast towers 21, 22 are pivoted behind the base plate 20 by the extension movement of the piston rod of the cylinder 9, while the retraction movement of the piston rod results in the position of the ballast towers in accordance with FIGS. 1*a*, 2*a*.

Alternatively to the variant shown, rotary drives can also be provided instead of the lift cylinder 9 which drive corresponding pinions 1, 2, 4 directly. In this respect, either a separate rotary mechanism is provided for each pinion 1, 2, 4 or the pinions 1, 2, 4 are mechanically coupled as shown via a linkage 6 so that one common rotary drive is sufficient.

The effects on the crane payloads due to the continuous displacement of the center of gravity of the ballast are calculated online and output via the crane software. The load torque limitation of the crane control can thus be ideally utilized in every ballast position. Either the stroke of the hydraulic cylinder 9 or the angle of rotation of the ballast towers 21, 22 can be measured for the calculation of the position of the ballast towers 21, 22. To hold the arbitrary continuous location of the ballast towers 21, 22 in a secure position, the hydraulically actuated lift cylinder 9 is equipped with a lowering brake. The rotary encoder is equipped with a redundant cam limit switch to secure the angle measurement.

The invention claimed is:

1. A ballast apparatus (10) for attaching to a rear of a crane superstructure, said apparatus (10) having a base plate (20) which comprises corresponding connection points for attaching to the rear of the crane superstructure, wherein at least two carrier plates (7,8) for receiving stacked ballast plates (28) are separately connected to the base plate (20) from one another in an articulated manner and pivotable about separate vertical pivot axes (A, A'), and a common actuator (9) is provided for a synchronous actuation of the at least two carrier plates (7,8) and mechanically coupled via a linkage and/or a gear train to at least one of the pivotable carrier plates (7,8).

2. A crawler-mounted crane, having the superstructure and at least one ballast apparatus in accordance with claim 1 arranged thereat, with the crane comprising a crane control which calculates the influence of the displacement of the center of gravity resulting from the pivot movement of the carrier plates on a possible payload.

3. The crane in accordance with claim 2, wherein machine width can be set by pivoting the carrier plates of the ballast apparatus.

4. The ballast apparatus in accordance with claim 1, wherein the common actuator (9) is coupled to both said pivotable carrier plates (7,8).

5. A ballast apparatus for attaching to a rear of a crane superstructure, said apparatus having a base plate which comprises corresponding connection points for attaching to the rear of the crane superstructure, wherein at least two carrier plates for receiving stacked ballast plates are connected to the base plate in an articulated manner and pivotable about vertical pivot axes, and the carrier plates are pivotable to the rear, i.e. behind the crane rear or the base plate in an installation position.

6. The ballast apparatus in accordance with claim 5, wherein a common actuator is provided for a synchronous actuation of the at least two carrier plates.

7. The ballast apparatus in accordance with claim 6, wherein the actuator is a linear drive.

8. The ballast apparatus in accordance with claim 7, wherein the linear drive is a lift cylinder.

9. The ballast apparatus in accordance with claim 6, wherein the actuator as well as any mechanical coupling means and/or transmission means are supported at least largely on or at the base plate.

10. The ballast apparatus in accordance with claim 5, wherein the carrier plates are pivotable to the rear by approximately 90° in each case so that a width dimension of the ballast apparatus is reducible.

11. A ballast apparatus for attaching to a rear of a crane superstructure, said apparatus having a base plate which comprises corresponding connection points for attaching to the rear of the crane superstructure, wherein at least two carrier plates for receiving stacked ballast plates are connected to the base plate in an articulated manner and pivotable about vertical pivot axes, and the carrier plates are each connected in an articulated manner to the base plate pivotable via a carrier arm.

12. The ballast apparatus in accordance with claim 11, wherein an actuator is mechanically coupled via a linkage and/or a gear train to at least one carrier plate.

13. The ballast apparatus in accordance with claim 12, wherein the actuator drives one pinion per carrier plate which directly or indirectly drives an associated toothed arrangement of the carrier plate or of the carrier arm.

14. The ballast apparatus in accordance with claim 13, wherein the at least two driven pinions are mechanically connected to one another via a coupling rod to transmit the rotary movement of one pinion directly driven by the actuator to the coupled pinion.

15. The ballast apparatus in accordance with claim 13, wherein at least one pinion comprises a fixedly connected actuation lever for coupling with a piston rod of the actuator in the form of a lift cylinder.

16. The ballast apparatus in accordance with claim 12, wherein the actuator is coupled to both pivotable carrier plates.

17. The ballast apparatus in accordance with claim 11, wherein the carrier arm is connected in an articulated manner to the base plate by a finger-type fork connection.

* * * * *